US005908572A

United States Patent [19]

Nagumo et al.

[11] Patent Number: 5,908,572

[45] Date of Patent: Jun. 1, 1999

[54] DRIVING METHOD OF CERAMIC HEATING ELEMENT FOR AN INFRARED RAY SOURCE

[75] Inventors: Mutsumi Nagumo; Satoru Sakaue; Masahiro Uno; Masao Sakanaka, all of Tokyo, Japan

[73] Assignee: Fuji Electric Co., Ltd., Kawasaki, Japan

[21] Appl. No.: 08/914,032

[22] Filed: Jul. 21, 1997

[30] Foreign Application Priority Data

Jul. 23, 1996 [JP] Japan ..... 8-193389

[51] Int. Cl.[6] ..... H05B 1/02

[52] U.S. Cl. ..... 219/501; 219/494; 219/505; 338/22 R

[58] Field of Search ..... 219/504, 505, 219/501, 497, 494, 483, 486, 216; 323/319, 235, 236; 338/22 R

[56] References Cited

U.S. PATENT DOCUMENTS

| | | | |
|---|---|---|---|
| 4,282,422 | 8/1981 | Payne et al. | 219/486 |
| 4,606,306 | 8/1986 | Caron et al. | 123/179 H |
| 5,260,548 | 11/1993 | Todd et al. | 219/483 |
| 5,369,246 | 11/1994 | Nanos | 219/388 |
| 5,451,747 | 9/1995 | Sullivan et al. | 219/528 |
| 5,493,101 | 2/1996 | Innes | 219/50 |

*Primary Examiner*—Mark H. Paschall
*Attorney, Agent, or Firm*—Kanesaka and Takeuchi

[57] ABSTRACT

A ceramic heating element has been conventionally driven by direct-current voltage, but the direct-current voltage causes a problem in the heating element. Therefore, in a method of the present invention, an alternating current is supplied to the heating element by changing a direct current, so that deformation of the heating element can be prevented and reliability can be improved.

12 Claims, 4 Drawing Sheets

DRIVING METHOD OF CERAMIC HEATING ELEMENT FOR AN INFRARED RAY SOURCE

BACKGROUND OF THE INVENTION AND RELATED ART STATEMENT

The present invention relates to a driving method of a ceramic heating element which is used as a heating element for an infrared ray source.

FIG. 4 shows an example of a ceramic heating element, generally indicated by the numeral 1, as an infrared ray source.

A heating element 1 is constructed of a sheet member with a thickness of about 0.5 mm, which is formed by shaping a raw material powder into a sheet and burning or sintering the same. The sheet member is processed by an electrical discharge method to form a zigzag heating element 11 and linear lead members 12*a*, 12*b* and is attached to a ceramic tube 14 by heat-resistant adhesive material 13. Incidentally, 2*a* and 2*b* designate lead wires which are connected to the lead members 12*a* and 12*b*, respectively.

The ceramic heating element 1 as an infrared ray source shown in FIG. 4 is normally driven by a direct-current (DC) voltage so as not to cause unsteadiness or instability in the quantity of light. However, when a temperature at the heating element is around 1,500 ° C. and heating time becomes several hundred hours, a temperature distribution of the heating element may change locally or deformation might occur, ultimately resulting in disconnection.

Also, it is confirmed that this kind of abnormality remarkably occurs on the positive terminal side. It is presumed that this is not because of unevenness or heterogeneity of the material, but because of migration of atoms.

Therefore, an object of the invention is to prevent abnormality such as deformation being caused in the ceramic heating element as the infrared ray source, and to improve the reliability of the heating element.

Further objects and advantages of the invention will be apparent from the following description of the invention.

SUMMARY OF THE INVENTION

To achieve the aforementioned object, according to a first aspect of the invention, a ceramic heating element used as an infrared ray source is formed of a ceramic material and heated partially at high temperature by electricity, and is driven at a frequency higher than a heat response of the heating element, and by alternating-current (AC) voltage with high frequency outside an operation frequency band of an apparatus using an infrared ray source.

According to a second aspect of the invention, a ceramic heating element used as the infrared ray source is formed of a ceramic material and partially heated at high temperature by electricity, and is driven to change a polarity of the DC power supply at a frequency which does not impede operations of the apparatus using the infrared ray source.

According to a third aspect of the invention, a duty ratio of current polarity of the DC power supply is approximately 50% with a rectangular waveform.

According to a fourth aspect of the invention, the ceramic heating element as the infrared ray source may be formed of disilicide molybdenum as a principal material. According to further aspects of the invention, the heating element may be formed of molybdenum, silicon, or silicon carbide.

BRIEF DESCRIPTION OF THE DRAWINGS

FIG. 1(*b*) shows a first rectangular waveform;

FIG. 3(*b*) shows a second rectangular waveform; and

DETAILED DESCRIPTION OF PREFERRED EMBODIMENTS

Figure 1A:
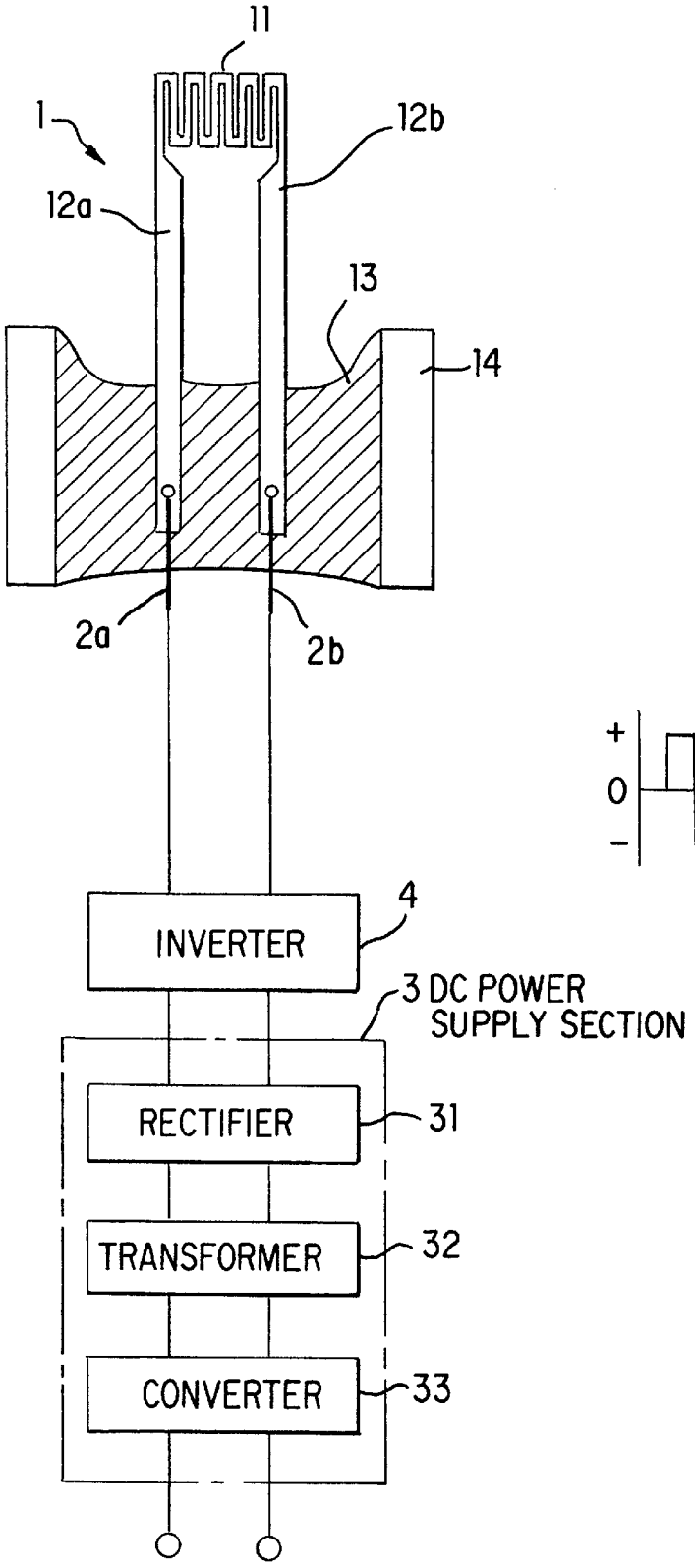
FIG. 1(*a*) shows a structure of a main part of a first embodiment of the invention.
Figure 1B:
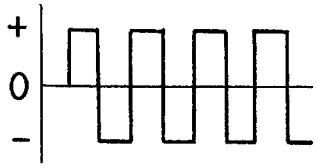

FIG. 1(*a*) shows a structure comprising a main part of a first embodiment of the invention.

Namely, with respect to a ceramic heating element 1, there are provided a DC power supply section 3 and an inverter 4, and it is arranged such that as shown in FIG. 1(*b*), a polarity of the DC power supply is switched in a predetermined cycle so that the ceramic heating element 1 is subjected to alternating-current (AC) driving.

Incidentally, at this time, it is required to choose a frequency which does not impede operations of an apparatus using the ceramic heating element as an infrared ray source.

Figure 2:
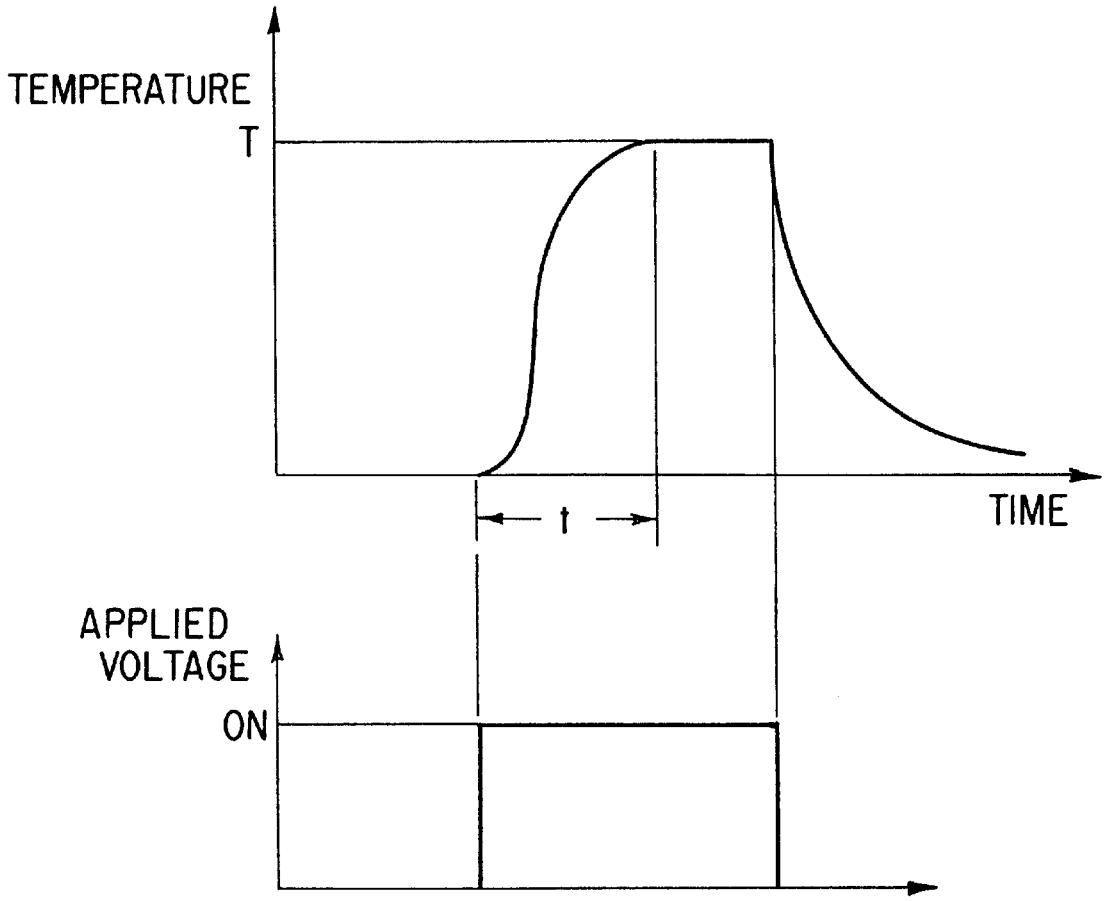
FIG. 2 shows a heat response characteristic of a ceramic heating element.

In this regard, an infrared gas analyzer is exemplified and additionally explained. FIG. 2 shows a heat response characteristic of the ceramic heating element 1. Namely, in case voltage as shown in FIG. 2 is applied to the ceramic heating element 1, the ceramic heating element 1 reaches a predetermined temperature T, which is required as a light source of the infrared gas analyzer, after t hours since voltage is started to be applied, i.e. t hours after the leading edge of the pulse, and maintains a predetermined temperature level until applied voltage is stopped. According to experiments by the inventors of the present invention, when an external dimension of the ceramic heating element 1 is 0.5×3×5 mm, the heat response frequency thereof is approximately 10 Hz. Therefore, in order to obtain the predetermined level of the quantity of light, as well as to prevent unsteadiness or instability in the quantity of light, it is required that a frequency of AC voltage for driving the ceramic heating element 1 be chosen to be a frequency more than this frequency, i.e. 10 Hz, the heat response frequency of the heating element.

Also, in the infrared gas analyzer, it is structured to repeatedly output detected signals according to rotation of a chopper for making an infrared ray emitted from the ceramic heating element 1 to be interrupted light, and the operation frequency thereof, i.e. detected frequency band, is normally set to be in a range of several Hz to several tens of Hz. It is desirable that the frequency of AC voltage for driving the ceramic heating element 1 is chosen to be high frequency outside the detected frequency band of the infrared gas analyzer.

By deciding frequency upon considering the aforementioned two points, and by alternatingly driving the ceramic heating element 1 in FIG. 1(*a*), it has been confirmed by the results of numerous experiments that abnormality in a temperature distribution of a heating section 11 and deformation thereof can be prevented. It is presumed that this is because AC driving can prevent migration of silicon atoms or molybdenum atoms contained in the ceramic heating element. Incidentally, as a material of ceramic, molybdenum, silicon, or silicon carbide (SiC) can be mainly used, but upon considering mechanical strength, it is desirable to use molybdenum disilicide.

When the comparative experiment was conducted on condition that molybdenum disilicide was used in the ceramic heating element 1 and heated at high temperature more than 1,400° C., it was confirmed that in case of DC driving, change of temperature distribution or deformation was caused in the heating section around one hundred hours, but in case of AC driving with 50 Hz, troubles occurred in DC driving did not occur even after thousands hours had passed.

Further, although in this embodiment, AC voltage is obtained through a DC power supply 3, which is formed of a rectifier 31, a transformer 32, and a converter 33 or the like and outputs DC power, and through an inverter 4 converting DC power into AC power, it is needless to say that the invention is not limited to this structure. Namely, frequency thereof and waveform (sine wave, rectangular wave, trapezoid wave and the like) can be voluntarily chosen, as long as there is satisfied condition that the heat response characteristic is not effected (i.e., the frequency is more than heat response characteristic) and, also the frequency is a high frequency outside the detected frequency band of the apparatus using the infrared ray source, such as an infrared ray analyzer, since it is used as a light source. Thereby, unsteadiness or instability in the quantity of light can be prevented, and driving substantially the same as that of DC voltage can be available.

Figure 3B:
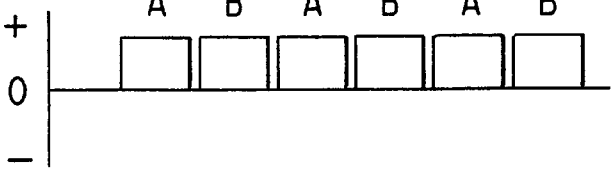
FIG. 3(*a*) shows a structure of a main part of a second embodiment of the invention.
Figure 3A:
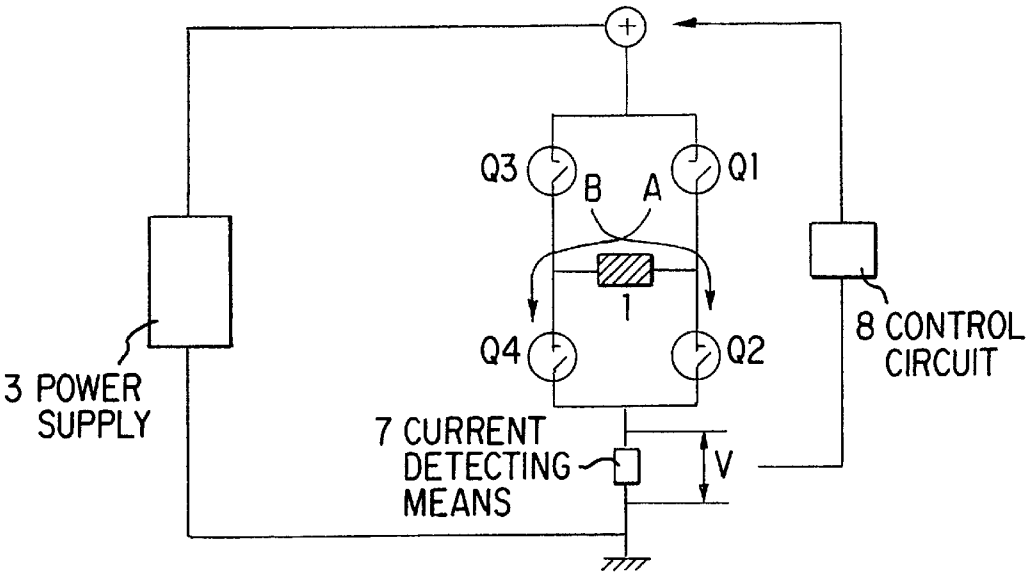
Figure 4:
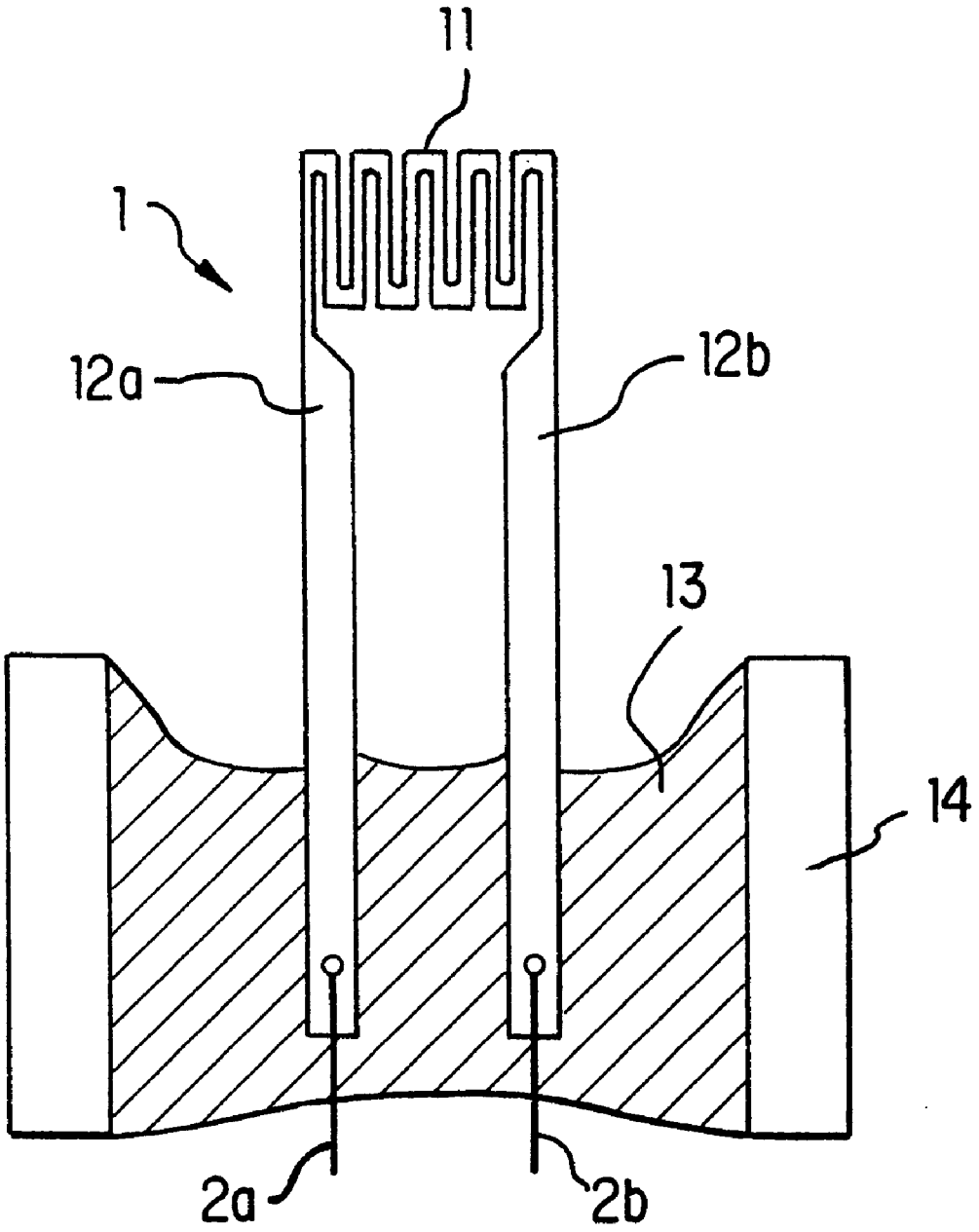
FIG. 4 shows an example of the ceramic heating element as an infrared ray source.

Next, by referring to FIGS. 3(*a*) and 3(*b*), a second embodiment of the invention is explained.

In the second embodiment, it is arranged that the ceramic heating element 1 is AC or alternatingly driven in the rectangular waveform at a duty ratio for a current with approximately 50% (in view points of a duty ratio for a voltage and a duty ratio for an ON-OFF operation, the duty ratio will be approximately 50%). In FIG. 3(*a*), numeral 1 designates a ceramic heating element, numeral 3 designates a DC power supply, and Q1 through Q4 designate FET (field-effect transistor) elements for electricity. Here, when Q1 and Q4 are turned ON and Q3 and Q2 are turned OFF, an electric current flows in the direction of an arrow A; on the other hand, when Q3 and Q2 are turned ON and Q1 and Q4 are turned OFF, the electric current flows in the direction of an arrow B. Therefore, by arranging FET elements Q1 through Q4 to perform switching operations so as to alternately repeat these conditions shown by the arrows A and B, and by accordingly changing the direction of the electric current instantly, it is possible to alternatingly drive the ceramic heating element 1 in the rectangular waveform with a duty ratio of approximately 100% as an ON-OFF operation (about 50% as a current), in which OFF time is several microseconds and ON time is several hundred milliseconds as shown in FIG. 3(*b*).

Incidentally, numeral 7 designates current detecting means formed of a resistor, and if it is arranged that a voltage drop v thereof is detected and a feedback signal is given to a control circuit 8, controlling the electric current with high precision can be available.

According to the second embodiment, it is needless to say that deformation does not occur in the ceramic heating element 1, and also unsteadiness or instability in the quantity of light can be completely eliminated to thereby enable driving substantially the same as with DC voltage.

According to the present invention, since it is arranged that the heating section of the ceramic heating element is driven by the AC voltage with a frequency higher than the predetermined frequency, a change with the passage of time in the quantity of light in the light section can be reduced, so that long life thereof can be available, resulting in an advantage such that reliability can be extremely improved.

While the invention has been explained with reference to the specific embodiments of the invention, the explanation is illustrative and the invention is limited only by the appended claims.

What is claimed is:

1. A method for driving a ceramic heating element for an infrared ray source, comprising:

preparing a ceramic heating element formed of a ceramic material and having a heating section heated by electricity, said ceramic heating element having a heat response which is an interval from a time when a predetermined voltage is applied to the ceramic heating element, to a time when a predetermined level of temperature is constantly maintained at the ceramic heating element, using the ceramic heating element for an infrared ray source of an infrared gas analyzer, and driving the ceramic heating element by alternating-current voltage with a frequency higher than the heat response of the ceramic heating element in order not to be influenced by the heat response, said frequency being different from an operational frequency band of the infrared gas analyzer using the infrared ray source.

2. A method for driving a ceramic heating element according to claim 1, wherein the ceramic heating element for the infrared ray source is mainly formed of molybdenum disilicide.

3. A method for driving a ceramic heating element according to claim 1, wherein the ceramic heating element is selected from the group consisting of molybdenum, silicon, and silicon carbide.

4. A method for driving a ceramic heating element according to claim 1, wherein the ceramic heating element is driven alternatingly by rectangular waveforms.

5. A method for driving a ceramic heating element according to claim 1, wherein said alternating-current voltage is supplied to the ceramic heating element by a DC power supply section through an inverter.

6. A method for driving a ceramic heating element for an infrared ray source, comprising:

preparing a ceramic heating element formed of a ceramic material and having a heating section heated by electricity, using the ceramic heating element for an infrared ray source of an infrared gas analyzer, and driving the ceramic heating element by changing polarity of a direct current at a frequency which does not impede operations of the infrared gas analyzer using the infrared ray source.

7. A method for driving a ceramic heating element according to claim 6, wherein a duty ratio of current polarity of the DC power supply is approximately 50% with a rectangular waveform.

8. A method for driving a ceramic heating element according to claim 6, wherein the ceramic heating element for the infrared ray source is mainly formed of molybdenum disilicide.

9. A method for driving a ceramic heating element according to claim 6, wherein the ceramic heating element is selected from the group consisting of molybdenum, silicon, and silicon carbide.

10. A method for driving a ceramic heating element according to claim 7, wherein OFF time is several microseconds and ON time is several hundred milliseconds.

11. A method for driving a ceramic heating element according to claim 6, further comprising detecting a voltage drop of the direct current applied to the ceramic heating element, said voltage drop being obtained by current detecting means connected to the ceramic heating element, and controlling electricity to the ceramic heating element based on the voltage drop.

12. A method for driving a ceramic heating element according to claim 11, wherein a first pair of transistors arranged in series and a second pair of transistors arranged in series are arranged parallel to each other, and the ceramic heating element is connected at one end to a middle of the first pair of transistors and at the other end to a middle of second pair of transistors.

* * * * *

UNITED STATES PATENT AND TRADEMARK OFFICE

CERTIFICATE OF CORRECTION

PATENT NO : 5,908,572

DATED : June 1, 1999

INVENTOR(S) : Mutsumi Nagumo; Satoru Sakaue; Masahiro Uno; Masao Sakanaka

It is certified that error appears in the above-identified patent and that said Letters Patent is hereby corrected as shown below:

In column 4, line 67, change "6" to --10--.

Signed and Sealed this

Fifth Day of October, 1999

*Attest:*

*Attesting Officer*

Q. TODD DICKINSON

*Acting Commissioner of Patents and Trademarks*